United States Patent [19]

Fantozzi

[11] 4,348,099

[45] Sep. 7, 1982

[54] CLOSED LOOP CONTROL OF REPRODUCTION MACHINE

[75] Inventor: Louis J. Fantozzi, Penfield, N.Y.

[73] Assignee: Xerox Corporation, Stamford, Conn.

[21] Appl. No.: 137,667

[22] Filed: Apr. 7, 1980

[51] Int. Cl.[3] ..... G03G 15/00

[52] U.S. Cl. ..... 355/14 E; 355/14 D; 355/14 CH; 355/71; 355/77

[58] Field of Search ..... 355/14 E, 14 D, 14 CH, 355/67, 68, 69, 70, 71, 77, 50, 51, 11

[56] References Cited

U.S. PATENT DOCUMENTS

| | | | |
|---|---|---|---|
| 3,788,739 | 1/1974 | Coricole | 355/14 E |
| 4,215,930 | 8/1980 | Miyakawa et al. | 355/14 D |
| 4,226,525 | 10/1980 | Sakamoto et al. | 355/14 DR |
| 4,248,527 | 2/1981 | Akiyama et al. | 355/14 D X |

FOREIGN PATENT DOCUMENTS

| | | | |
|---|---|---|---|
| 1559341 | 1/1980 | United Kingdom | 355/14 E |

OTHER PUBLICATIONS

"Automatic Dispensing Control"–William Kurrasch, Xerox disclosure, vol. 5, No. 2, 3/80, p. 199.

*Primary Examiner*—J. V. Truhe
*Assistant Examiner*—Richard M. Moose
*Attorney, Agent, or Firm*—Ronald F. Chapuran

[57] ABSTRACT

The present invention is a sample data control system having (a) a charge control loop for eliminating photoreceptor dark discharge variations due to photoreceptor fatigue and aging to maintain a constant dark development potential, (b) an illumination control loop eliminating variations in the lamp irradiance to maintain a constant background potential, (c) a toner dispensing control loop regulating toner flow using a sensor approach directly sensing developed images to eliminate toner mass variations and (d) a bias control loop to maintain optimum density images on the photoreceptor in spite of changing humidity conditions. Two test targets, each having two test patches are selectively exposed in various combinations to provide test data in the photoreceptor image area for suitable sensing and control of the charge, illumination, toner dispensing, and bias control loops.

20 Claims, 20 Drawing Figures

CLOSED LOOP CONTROL OF REPRODUCTION MACHINE

This invention relates to a reproduction machine and in particular to an improved method and apparatus for the automatic adjustment of the machine control parameters.

Closed loop control and adjustment of particular reproduction machine parameters is generally well known. For example, U.S. Pat. No. 2,956,487 generally discloses that individual control signals can be used to adjust operating elements of a reproduction machine such as controlling the developer through control of the developer powder ratio and the magnetic brush bias. It also discloses the control of illumination through the adjustment of the voltage to the illuminating lamp and adjustment of a mechanical iris.

Other systems in the prior art describe exposure control, for example, U.S. Pat. No. 3,985,440 teaches the measuring of illumination in the plane of a photosensitive material, comparing the voltage produced with a reference voltage, and terminating exposure when a predetermined difference between the two voltages is reached. Other systems such as U.S. Pat. No. 3,279,312 determine the relative brightness of a document to be photographed and in response increase or decrease the intensity of illumination of the document as it is photographed. Other systems such as disclosed in U.S. Pat. No. 3,996,494 show the technique of measuring the energy output of a lamp and adjustment of the input to the lamp to compensate for degradation with time of the output intensity. Other systems such as disclosed in U.S. Pat. No. 3,818,496 teach a control system responsive to factors such as the recording medium, the relative motion between the recording medium and the illumination source, the image to be formed on the recording medium, and the dynamics of the system causing the relative motion between the source and the recording medium.

Another type of illumination control shown in U.S. Pat. No. 4,035,814 is a flash apparatus controlled by a digital memory. In particular, flash illumination is provided while an oscillator produces pulses having a frequency determined according to factors such as light intensity or the distance of the object from the flash apparatus. The pulses are counted by a memory device set to terminate the counting of the pulses according to one or more parameters such as film speed, or the diaphragm aperture. Other systems such as disclosed in U.S. Pat. No. 4,136,277 teach the use of an imaging period and a calibrating period. In particular, a lamp illumination control loop provides a reference control signal to the lamp during a calibration period and the intensity of the light detected during the calibration period is compared with the reference control signal for controlling the countdown of a digital counter. During the subsequent imaging period, a circuit maintains the counter output constant to generate the calibrated control signal.

Other systems such as disclosed in U.S. Pat. Nos. 4,179,213; 3,348,522; 3,348,523 and 3,376,853 disclose the adjustment and automatic control of a developer in a reproduction machine. In particular, a clean drum signal is compared to a signal reflected from a test pattern formed on the drum. Separate sensors are used for detecting each signal. The outputs of the sensor are compared by a bridge circuit to provide an error signal, and a toner dispenser is operated in response to the error signal. In these systems, the degree of development is measured directly from a developed test stripe on the photoreceptor drum extending along the peripheral edge of the drum and in some cases, extending into the photoreceptor image area.

In systems such as shown in U.S. Pat. Nos. 3,873,002 and 4,065,031, an electrically biased transparent electrode disposed on the photoreceptor surface is conveyed past the development station to attract toner particles. Light is transmitted from within the photoreceptor through the transparent electrode and detected by a photosensor located near the photoreceptor surface. The photosensor provides a signal indicative of the density of toner particles on the transparent electrode.

Other systems control toner dispensers by measuring toner concentration in the developer mixture contained in a developer housing or reservoir, for example, U.S. Pat. No. 3,233,781. Other systems such as disclosed in U.S. Pat. No. 3,719,165 control a toner replenisher by measuring the electric potential of a magnetic developing brush. In other approaches to improved toning, the potential of an electrode in the development station is adjusted as a function of the charge density of the electrostatic image. For example, U.S. Pat. No. 3,779,204 teaches the use of an electrometer probe disposed near a photoreceptor belt to provide auto bias and also produces a signal to actuate a toner dispenser through threshold circuitry.

A difficulty with the prior art systems is that, in general, they adjust only one or two parameters out of a variety of parameters that affect copy quality and machine efficiency.

However, in providing optimum copy quality in a xerographic machine environment, various factors dealing with electrostatics, and development must be considered. These factors include photoreceptor thickness fatigue and temperature, exposure lamp illumination variations, developer age and high humidity conditions. In the case of development, for example, high humidity conditions cause excessively high density images and variations in line and solid area density relationships.

In addition to the difficulty of compensating for a variety of changes in characteristics, prior art systems are often only analogs, that is, do not directly monitor conditions, for example, the amount of toner mass developed on the photoreceptor surface in the image area. Even if providing for adjustment of a plurality of parameters, many systems require continuous sampling outside the image area and do not provide for the flexibility and concise adjustment provided by a sample data system with measurements taken in the image area.

Prior art systems also often require separator sensors and sampling devices for each parameter controlled. In a system providing for control of a variety of parameters, this can be complex and costly. It would therefore be desirable to provide a sample data system to measure various characteristics in the inner document space of the photoreceptor to more accurately sense and control the electrostatic image potentials and developed toner mass.

It would be desirable therefore to provide a control system that adjusts for these various factors affecting copy quality using sampled data that is directly related to the parameter to be controlled and a control that is applicale to a wide variety of machine environments.

It is therefore an object of the present invention to provide a new and improved xerographic control system which accurately compensates for changes in a variety of characteristics to maintain optimum copy quality over a wide range of machine environments.

Briefly, the present invention is concerned with a sample data control system having (a) a charge control loop for eliminating photoreceptor dark discharge variations due to photoreceptor fatigue and aging to maintain a constant dark development potential, (b) an illumination control loop eliminating variations in the lamp irradiance to maintain a constant background potential, (c) a toner dispensing control loop regulating toner flow using a sensor approach directly sensing developed images to eliminate toner mass variations and (d) a bias control loop to maintain optimum density images on the photoreceptor in spite of changing humidity conditions. Two test targets, each having two test patches are selectively exposed in various combinations to provide test data in the photoreceptor image area for suitable sensing and control of the charge, illumination, toner dispensing, and bias control loops.

For a better understanding of the present invention, reference is made to the accompanying drawings wherein the same reference numerals have been applied to like parts and wherein.

Figure 2:
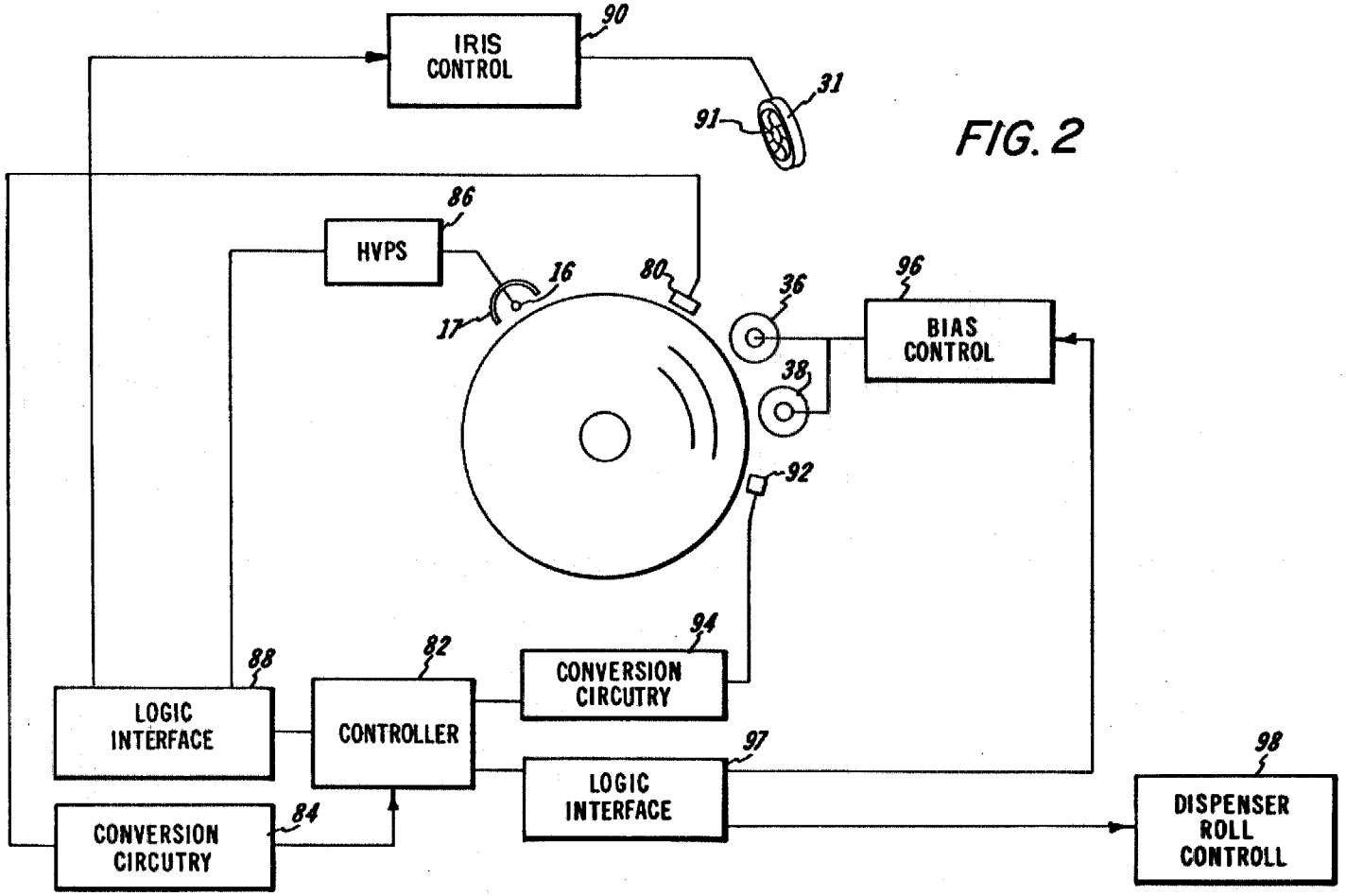
FIG. 2 is a block diagram illustration of the control loops in accordance with the present invention.
Figure 4A:
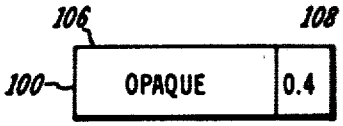
Figure 4B:
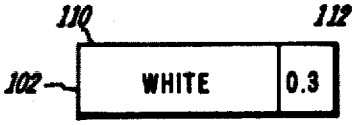
Figure 5A:
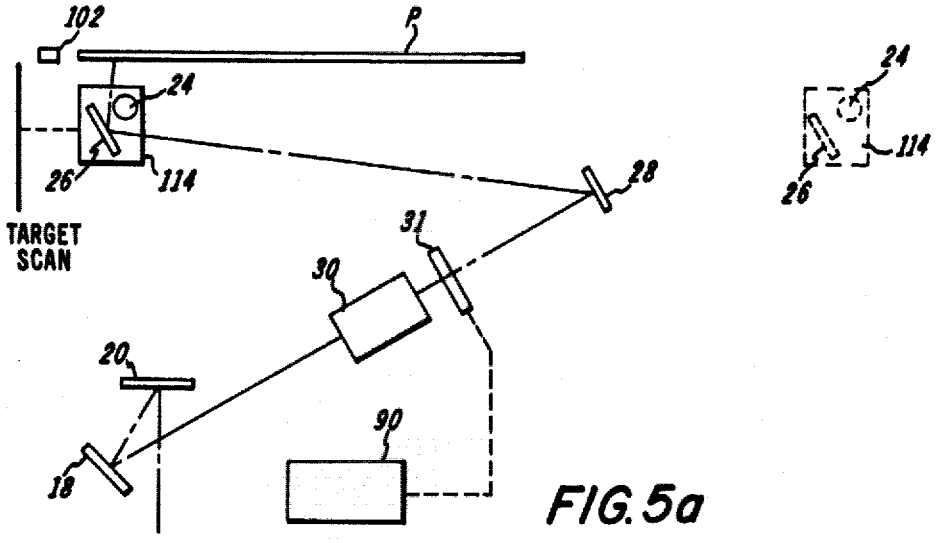
Figure 5B:
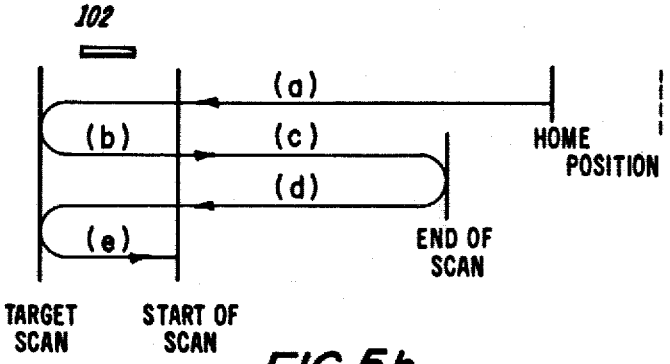
Figure 5C:
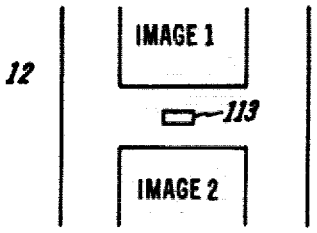
Figure 6:
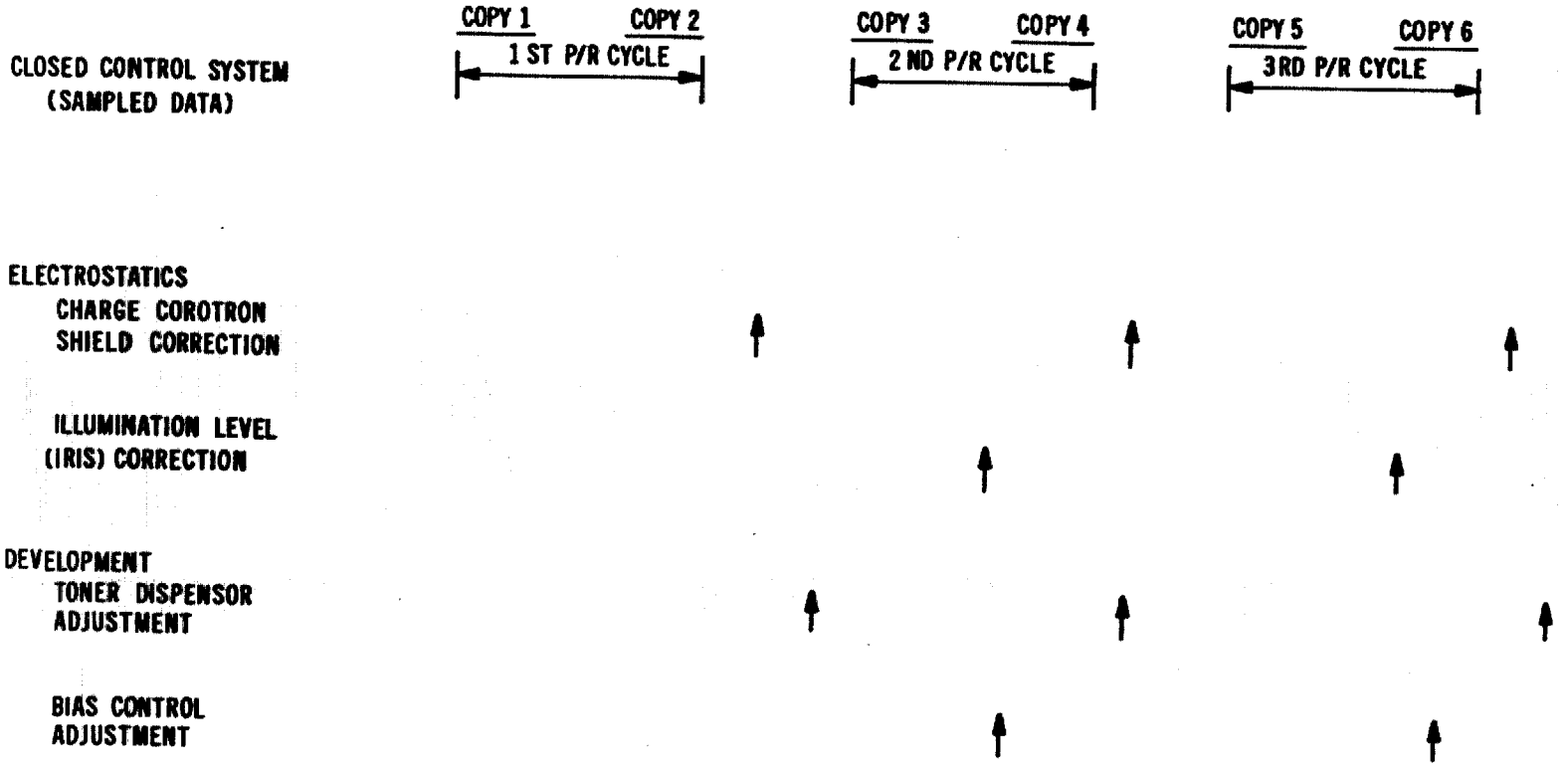
Figure 7:
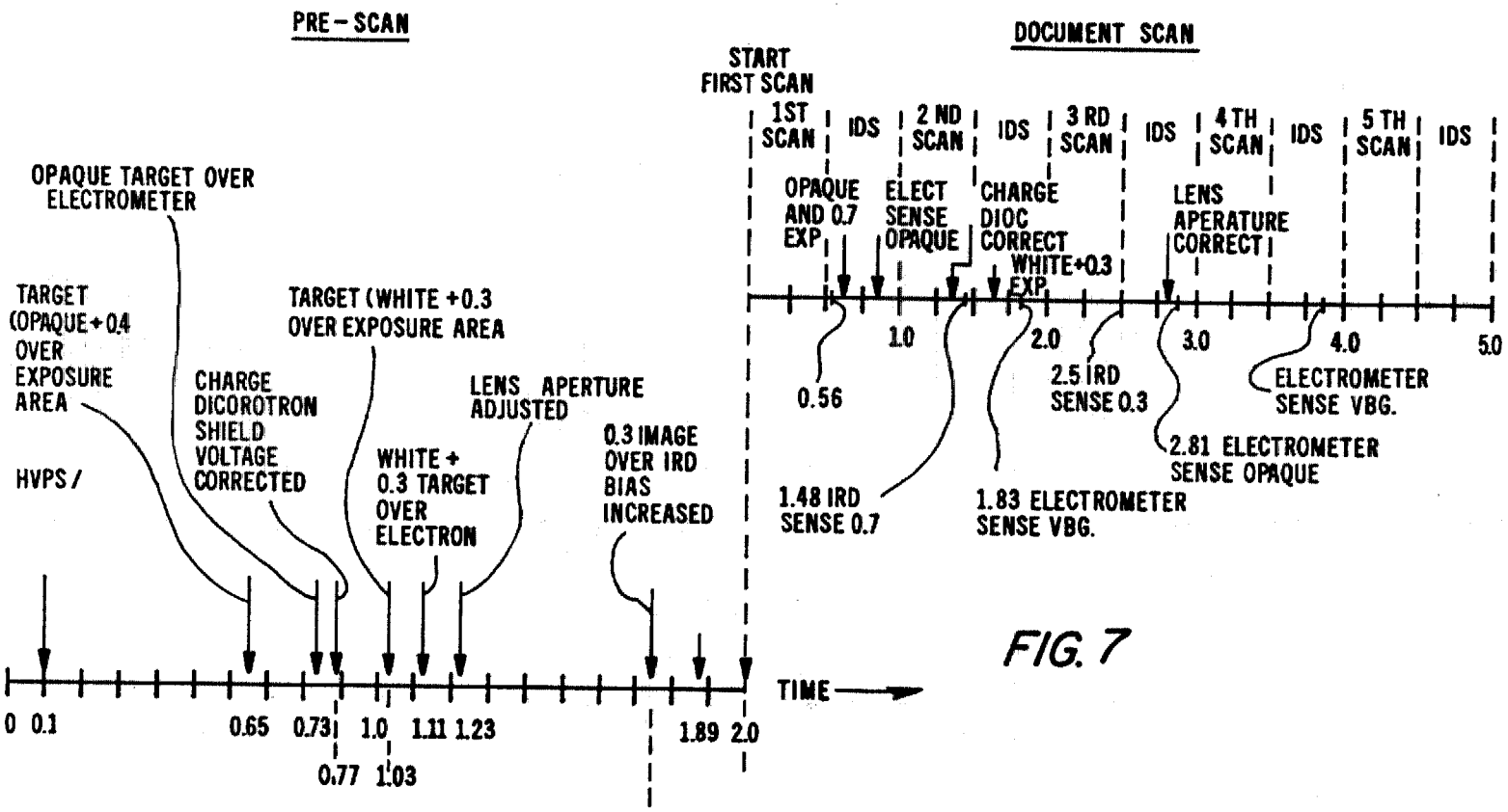
Figure 8:
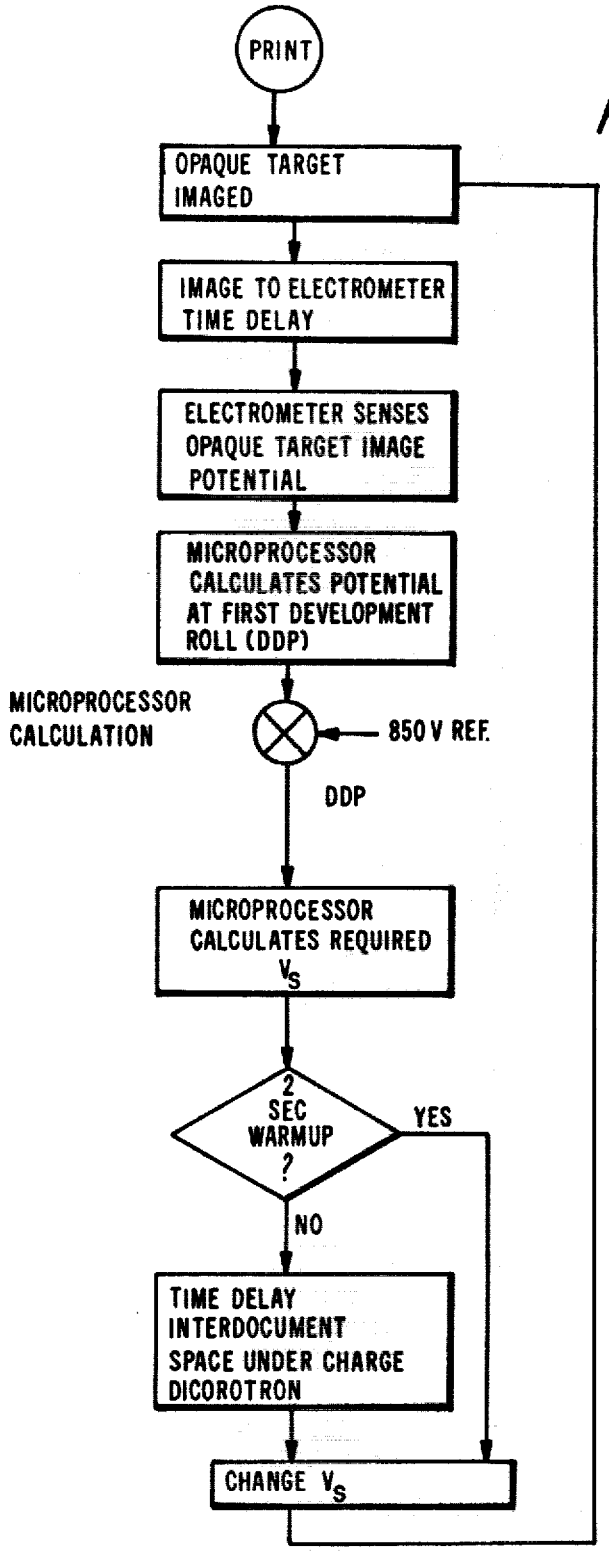
Figure 8A:
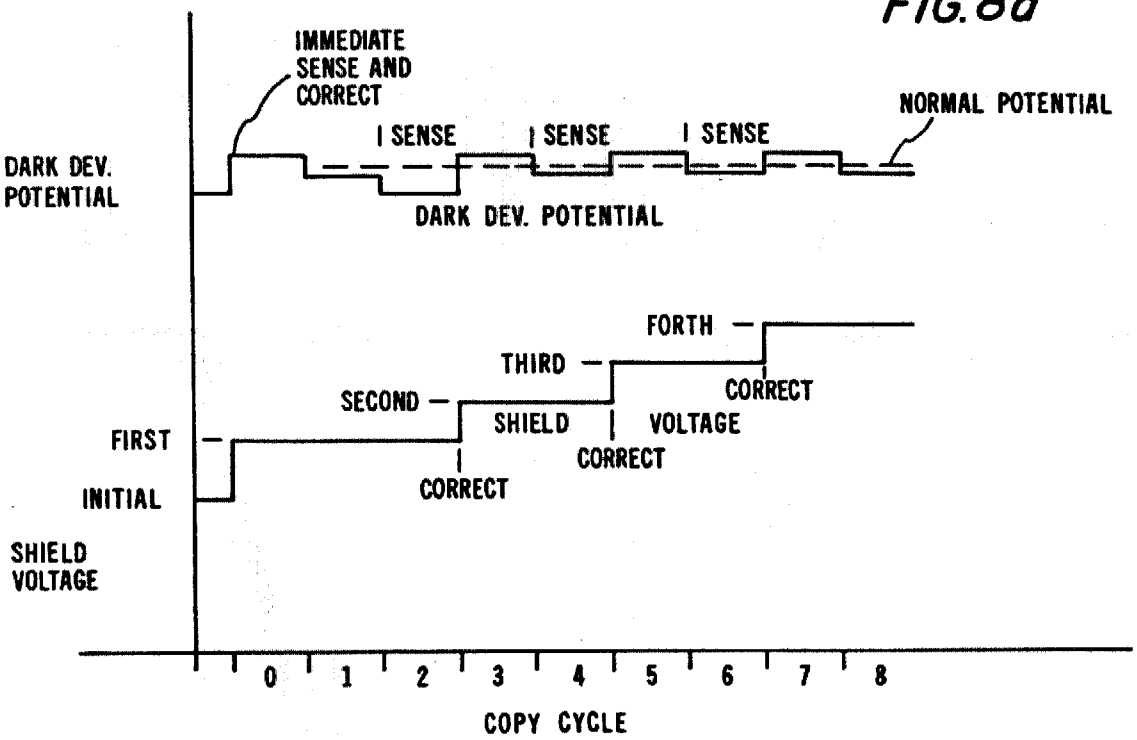
Figure 9:
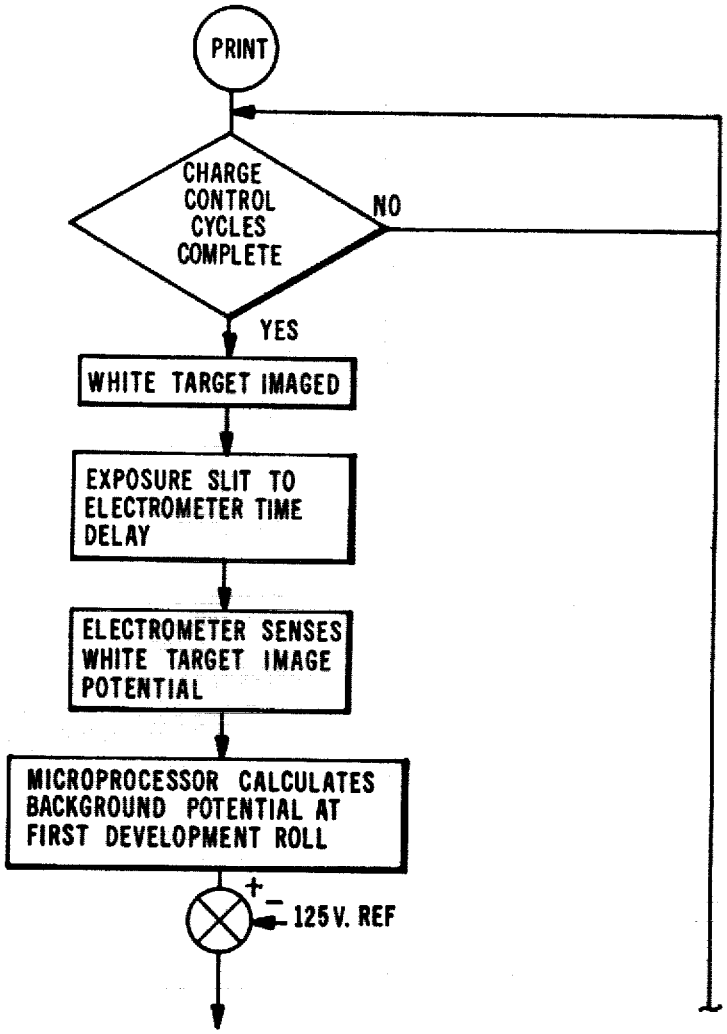
Figure 9A:
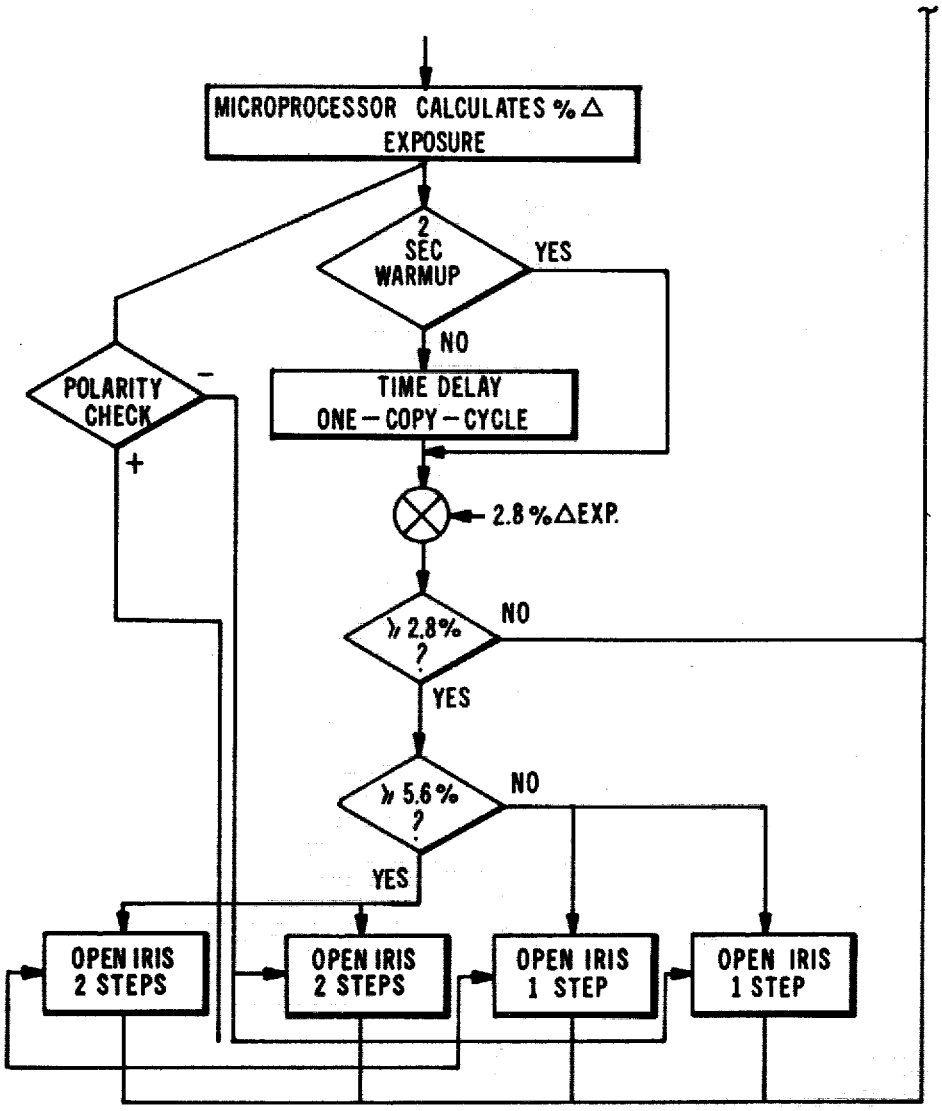
Figure 9B:
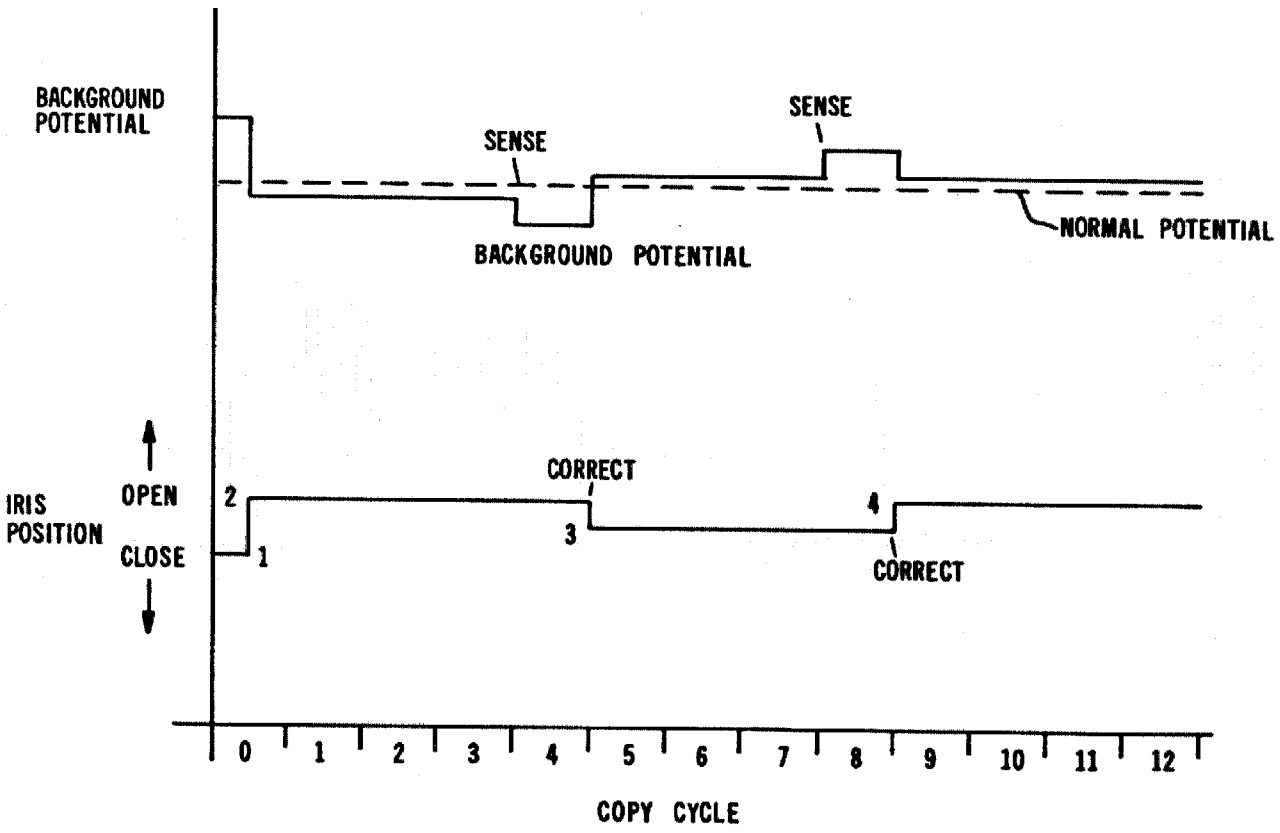

FIGS. 4*a* and 4*b* are detailed illustrations of the two test targets in accordance with the present invention;

FIGS. 5*a* and 5*b* illustrate the sequence document scan, and target prescan in accordance with the present invention;

FIG. 5*c* illustrates the image and target area relationship on the photoreceptor;

FIGS. 6 and 7 illustrate the timing sequences of the control loops illustrated in FIG. 2;

FIG. 8 is a flow chart of the charge control loop in accordance with the present invention;

FIG. 8*a* is a plot illustrating charge control;

FIG. 9 is a flow chart of the illumination control loop in accordance with the present invention;

FIG. 9*a* is a plot illustrating illumination control;

FIG. 9*b* is a copy cycle chart.

Figure 10:
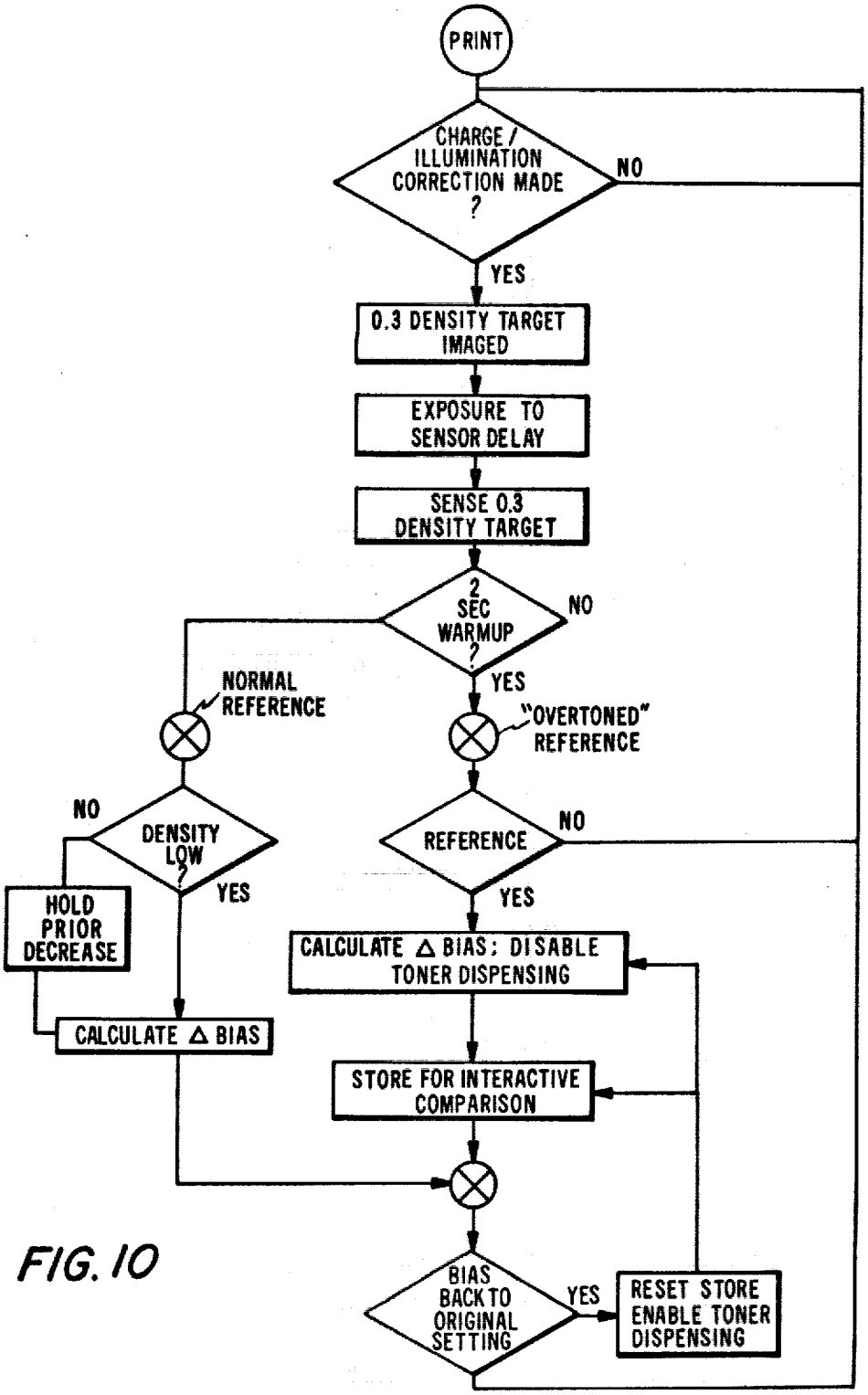
Figure 10A:
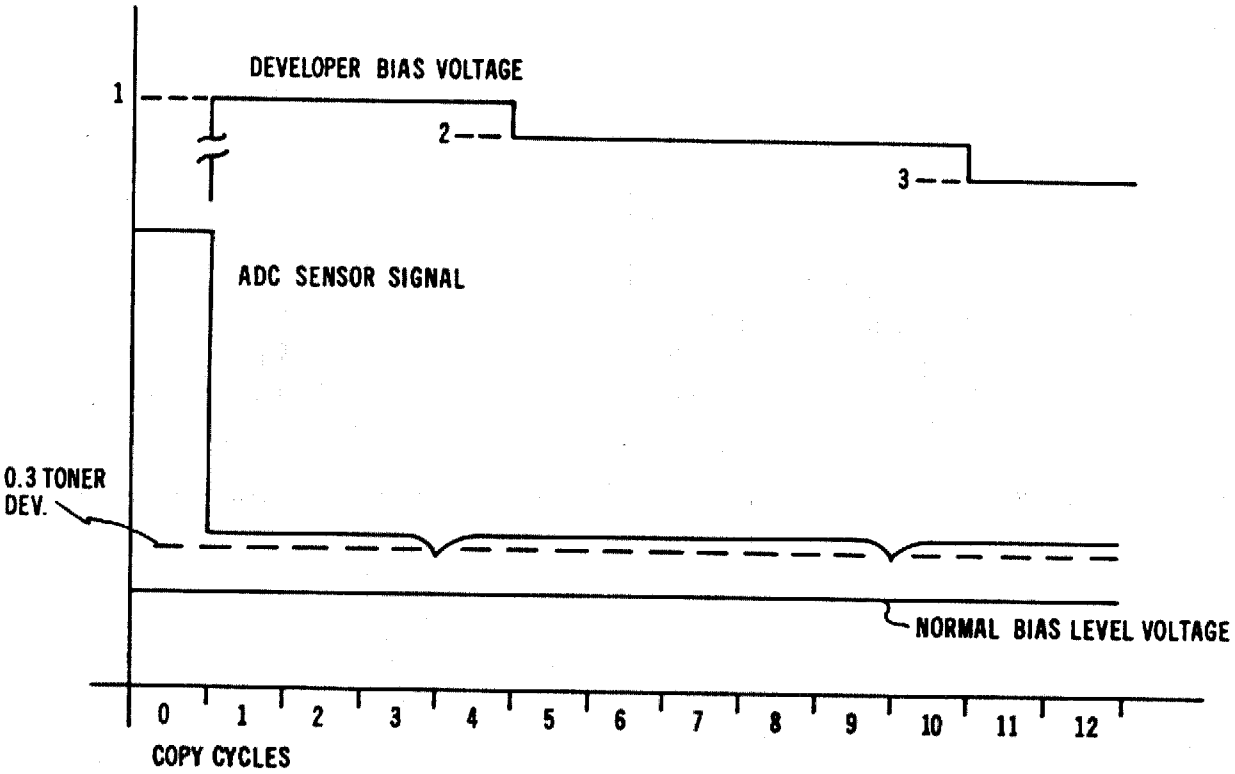
Figure 11:
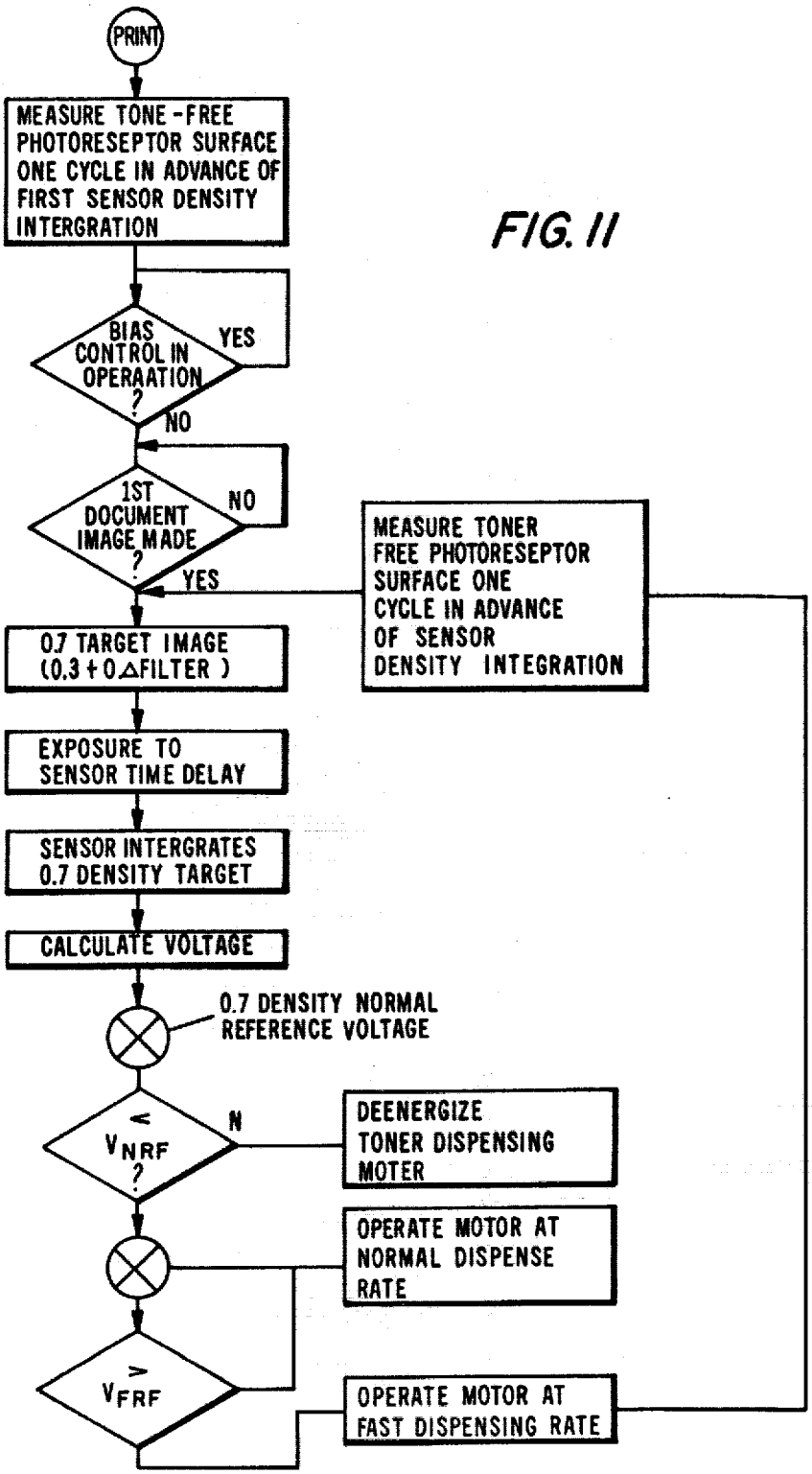
Figure 11A:
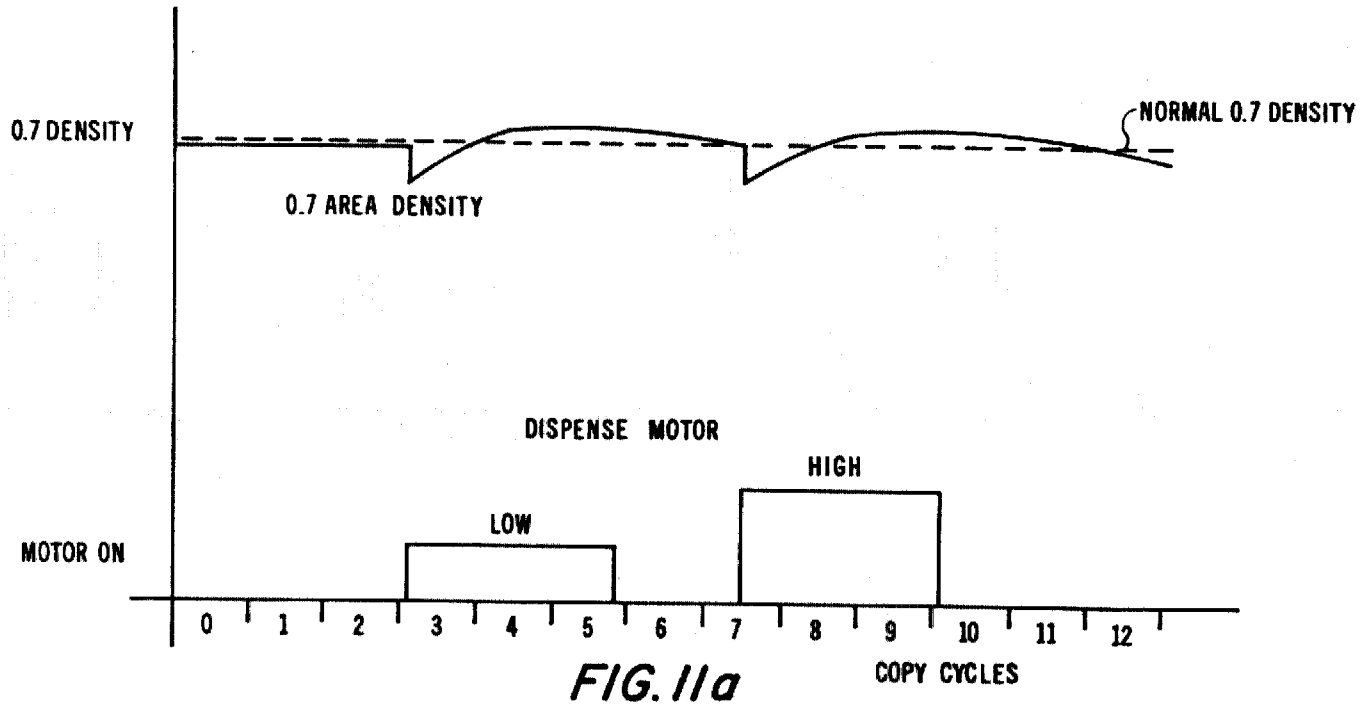

FIG. 10 is a flow chart of the bias control loop in accordance with the present invention;

FIG. 10*a* is a plot illustrating bias control;

FIG. 11 is a flow chart of the toner dispensing control loop in accordance with the present invention; and FIG. 11*a* is a plot illustrating toner dispense control.

Figure 12:
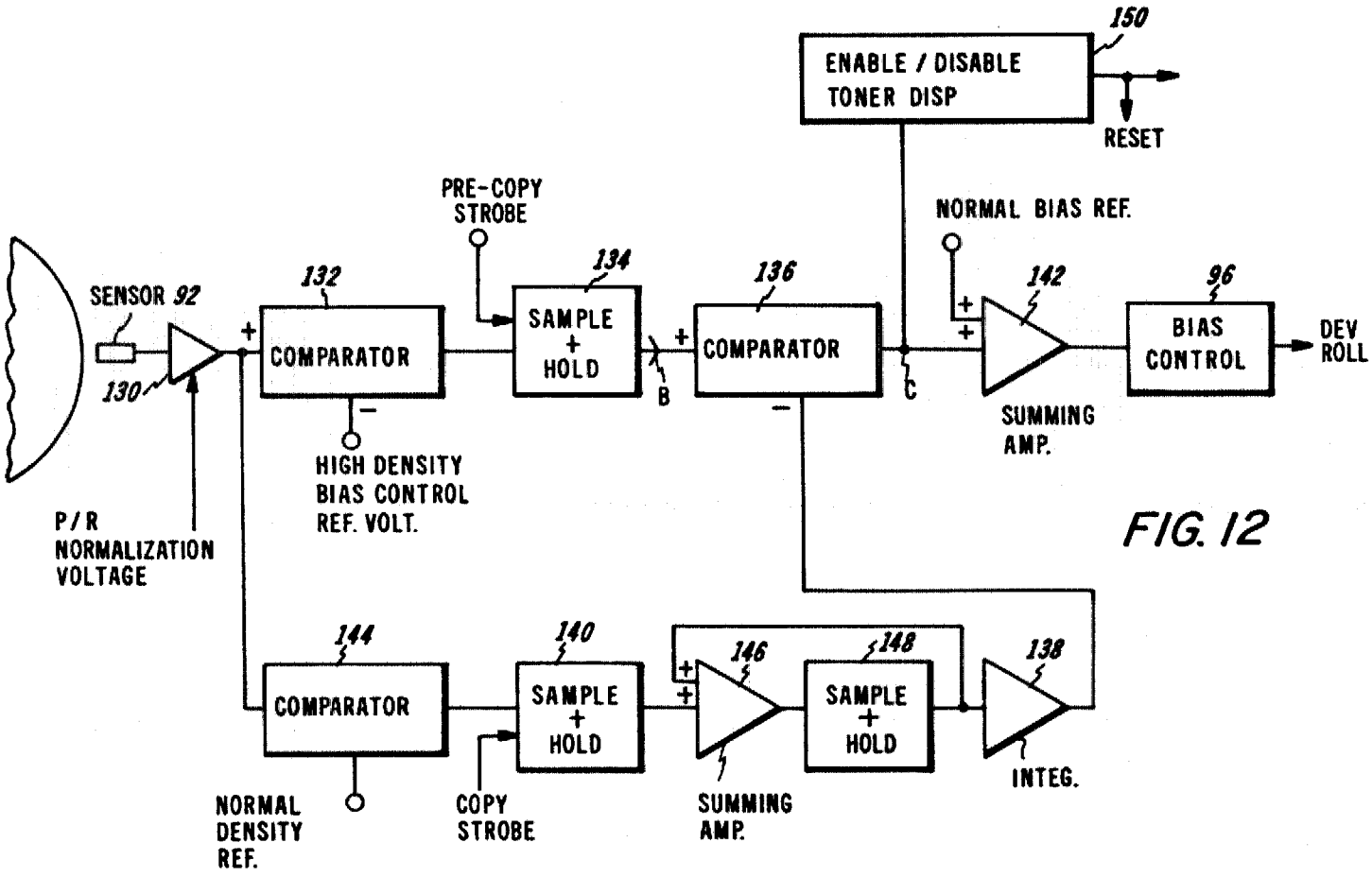

FIG. 12 is another view of the apparatus of the present invention.

DETAILED DESCRIPTION

Figure 1:
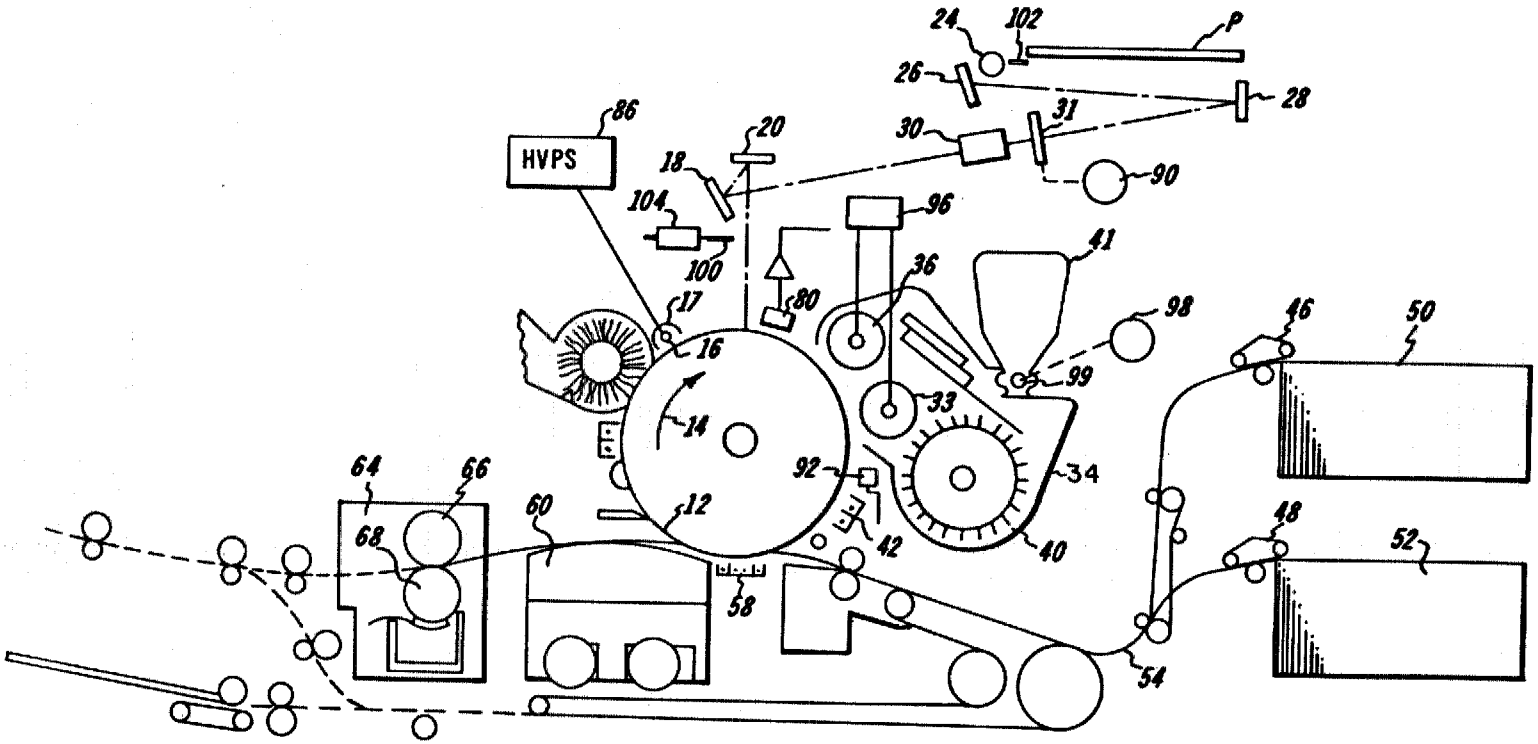
FIG. 1 is a pictorial of the apparatus incorporating the present invention.

For a general understanding of a reproduction machine in which the features of the present invention may be incorporated, reference is made to FIG. 1, depicting schematically the various printing machine components. A drum having a photoconductive surface 12 is rotated, in the direction of arrow 14 through a charging station. The charging station employs a corona generating device having a charging electrode 16 and conductive shield 17 positioned adjacent photoconductive surface 12 to charge photoconductive surface 12 to a relatively high uniform potential. A suitable corona generating device may be of the type described in U.S. Pat. No. 4,086,650 issued Apr. 25, 1978, the relevant portions thereof being incorporated into the present application.

The charged portion of photoconductive surface 12 is then rotated to an exposure station for producing a light image of an original document placed on platen P. In particular, lamp 24 illuminates incremental portions of the original document disposed on platen P in moving across the platen P. The light rays reflected from the original document are reflected by a full rate mirror 26 to a half rate mirror 28. Half rate mirror 28 reflects the light rays through iris 31 and lens 30 to mirrors 18 and 20. The surface 12 rotates in synchronism with the movement of the platen scanning optics.

As the surface 12 continues to rotate in the direction of arrow 14, the recorded electrostatic latent image is advanced to a development station including a housing 34 containing a supply of developer mix and a pair of developer rollers 36 and 38. Each developer roller includes a stationary magnetic member having a non-magnetic, rotatable tubular member interfit telescopically over the stationary member. The developer material is advanced to developer rollers 36 and 38 by paddle wheel 40 disposed in the sump of housing 34. Developer rollers 36 and 38 advance the developer mix into contact with the electrostatic latent image on surface 12. As successive electrostatic latent images are developed, the toner particles within the developer mix are depleted. Additional toner particles are stored in toner cartridge 41.

After the toner powder image has been developed on photoconductive surface 12, corona generating device 42 applies a charge to pre-condition the toner powder image for transfer. A sheet of support material is advanced by sheet feeding apparatus 46 or 48 from either tray 50 or tray 52. Conveyer system 54 advances the sheet of support material to a transfer station including a corona generating device 58 for charging the underside of the sheet of support material to a level sufficient to attract the toner powder image from photoconductive surface 12.

After transfer of the toner powder image to the sheet of support material, a vacuum stripping system 60 separates the sheet from photoconductive surface 12 and advances it to a fusing station 64.

The fusing station 64 includes a heated fuser roll 66 in contact with a resilient backup roll 68. The sheet of support material advances between fuser roll 66 and backup roll 68 with the toner powder image contacting fuser roll 66. After the toner powder image has been permanently fused to the copy sheet, the copy sheets are advanced by a series of rollers to suitable (not shown) output trays.

In accordance with the present invention, in order to maintain copy quality and compensate for copy to copy density variations, there are provided four control loops, namely a charge control loop, an illumination control loop, a bias control loop, and a toner dispensing control loop. In particular, with reference to FIGS. 1 and 2, in charge control, a D.C. electrometer 80, positioned adjacent to the photoreceptor surface 12 between the exposure station and development stations generates a signal proportional to the dark development potential on the photoreceptor surface. The dark development potential is the charge maintained on the photoreceptor after charging and exposure reflected from an opaque target or object. Preferably, the electrometer 80 is a nulling type device having a not shown probe and head assembly and the potential of the head and probe assembly is raised to the potential of the surface being measured. The generated signal is conveyed to controller 82 through suitable conversion circuitry 84. The controller 82 is also electrically connected to a high voltage power supply 86 through suitable logic interface 88 to control the bias voltage on the conductive shield 17 of the charging corotron to maintain a constant dark development potential.

In illumination control, the signal generated by the electrometer 80, proportional to background potential on the photoreceptor surface, is conveyed to controller 82 througb suitable conversion circuitry 84. The background potential is the charge on the photoreceptor after exposure with light reflected from a white target or object. The controller 82 activates iris control motor 90 to change the mechanical position of the iris 31 to alter opening 91 and modulate the illumination level at the photoreceptor surface to maintain a constant background potential. Preferably. the iris is driven by rotary solenoids and opens and closes in discrete steps equivalent to 2.8 percent changes in illumination per step. Fourteen iris adjustment steps provide 132 percent illumination variation.

In bias control, an infrared densitometer 92, positioned adjacent to the photoreceptor surface 12 between the developer station and the transfer station, generates an electrical signal proportional to the toner mass of a 0.3 solid area density test patch developed on the photoreceptor surface 12. This signal is conveyed to controller 82 through suitable conversion circuitry 94. In response, the controller 82 activates a bias control or power supply 96 through logic interface 97. The bias control 96 is electrically connected to the rotatable tubular member of the developer rollers 36 and 38 to vary the electric field between the developer rollers and the photoreceptor to maintain constant developability.

In automatic development control (ADC), the signal generated by infrared densitometer 92 proportional to developed toner mass is conveyed to the controller 82 through conversion circuitry 94. In response, the controller 82 activates a dispenser roll control or motor 98 mechanically connected to dispenser roll 99 to convey toner from the cartridge 41 to the developer housing 34 to adjust toner concentration.

Figure 3:
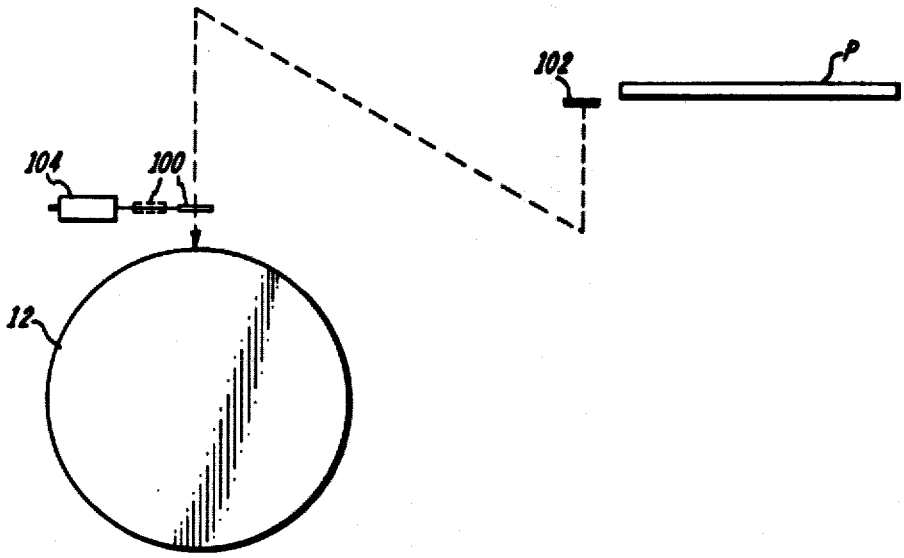
FIG. 3 is an illustration of the test targets according to the present invention in relation to the platen and photoreceptor surface shown in FIG. 1.

In accord with the present invention, there is shown in FIGS. 3, 4*a* and 4*b* a pair of test targets 100 and 102. Test target 100, located near the photoreceptor surface 12 is connected to solenoid 104 or any other suitable mechanism to position the target 100 into and out of the optical path illustrated in phantom at the photoreceptor surface 12 to block light from surface 12. Test target 102 is rigidly secured at the end of platen P and disposed to reflect light from exposure lamp 24 through the optical system to surface 12.

Test targets 100 and 102 are typically transmission filters with predetermined transmission characteristics. With reference to FIG. 4*a*, test target 100 is divided into an "opaque" target 106 having zero light transmission and target 108 having a 0.4 solid area density. Test target 102 shown in FIG. 4*b* is divided into a "white" target 110 providing total reflectivity of light and target 112 having 0.3 solid area density.

Targets 100 and 102 are imaged in the interdocument or inter-image area on surface 12 of the photoreceptor drum before the start of a new document imaging cycle. That is, the targets are imaged on surface 12 in the space between successive latent images of documents. The target 100 is positioned to closely overlay with target 102 along the optical path such that the opaque and white targets 106, 110 are in alignment and the 0.4 and 0.3 density targets 108, 112 are in alignment along the optical path to provide a 0.7 solid area density target when needed.

With reference to FIG. 5*a*, the scanning lamp 24 and mirror 26 are mechanically connected to a carriage 114. The position shown in dotted lines is the home or standby position of carriage 114 and the position shown in solid lines is the start of scan position. During scan, the motion of the carriage 114 is under control of a not shown servo controller.

With reference to FIG. 5*b*, there is illustrated a typical scanning sequence. In particular, there is an initialization scan before the first document scan. The carriage moves initially from the home position to the start of scan position illustrated at (a) and then from the start of scan position underneath the target 102 and back to the start of scan position illustrated at (b). This provides the first image of the black target 106 and white target 110 on the photoreceptor surface 12. The carriage then scans from the start of scan position to the end of scan position. This is the initialization scan without a document on the platen P illustrated as (c). The carriage 114 then remains at the end of scan position until the initial document scan takes place. For the first document scan, the carriage first moves from the end of scan position to position start of scan (d) and then moves to the target scan position and back to start of scan, illustrated as (e) for a second target scan. Finally, the carriage 114 moves from the start of scan position to the end of scan position for the document scan.

The various test targets are imaged in the interdocument area as seen in FIG. 5*c* to initiate the four control loops. In particular, the photoreceptor surface 12 is illustrated as containing two document images, image 1 and image 2. The sample 113 is illustrated in the interdocument space between image 1 and image 2 and is that portion of the photoreceptor sensed by electrometer 80 and infrared densitometer 92 to provide the signals for control. In essence, the present invention is a sample data rather than continuous data control system permitting accurate sense and correction outside the document image area.

The timing sequence is illustrated with reference to FIG. 6. In general, one photoreceptor cycle represents two document images or two copies during the document imaging process.

After the start print button is activated, there is a prescan cycle with reference to FIGS. 5*b* and 7 in the following sequence. The target 100 is exposed. The opaque target 106 exposure is sensed at the electrometer 80, and then the charge dicorotron shield 17 voltage is adjusted to return the dark development potential to the desired setpoint in the next interdocument area. At this point, the 0.4 target 108, although imaged, is not used by the control system. As the scanning carriage 114 passes over the target 102, the white target 110 and 0.3 target 112 are exposed. Next, the white target exposure is over the electrometer 80 and in response to the electrometer voltage, the iris aperture 91 is adjusted. Then, the 0.3 developed image reaches the IRD sensor 92 and in response to the IRD sensor 92, the bias control 96 is activated if required. There are two similar prescans before the first document is imaged providing a white target image, an opaque target image, and a 0.3 target image. The purpose of the prescan sequence is to image the targets, reset the charge corotron shield, illumination level and developer bias if required and set the rate of scan of the scanning carriage.

A correction if needed for each of the control loops is made in the next interdocument area after a sense has been made. Corrections are not made in the image area to prevent copy quality non-uniformities from occurring. The dicorotron shield adjustment and toner dispense adjustment are made after copy one and copy two scans and after each photoreceptor cycle thereafter. The illumination level and bias control adjustments are made after the copy three scan, the first document scan of the second photoreceptor cycle. Thereafter the adjustments are made in the middle of successive photoreceptor cycles as shown in FIG. 6.

The scanning carriage 114 begins the first copy scan as illustrated in the right half of FIG. 7, and after completion of the first copy scan, the opaque and 0.4 targets are exposed in the inter document space (IDS). The opaque and 0.4 targets under solenoid control, are inserted in the optical path in the same position as the white and 0.3 targets during the overlap scan operation. In effect, therefore, an opaque and a 0.7 target will be exposed. With reference to FIG. 7, in the scan mode, before the start of the second scan, the exposed photoreceptor surface 12 will have moved to a position for sensing by the electrometer 80. The electrometer 80 will sense the opaque target 106 and at the end of the second scan in response to the electrometer 80, the charge dicorotron shield 17 voltage will be corrected. This is illustrated in FIG. 7 by the arrow indicating an adjustment at the end of the second document scan.

At the end of the second document scan, the photoreceptor surface 12 has moved into position for sensing of the 0.7 density target and the toner dispenser roll control 98 may be activated at this time if required if the system is not in the bias control mode. The system is either initially in the bias control mode to adjust developer bias to account for high humidity and the resultant high image density and background potentials or in the toner dispense control mode but never in the two modes simultaneously.

After the end of the second document scan, during the white target scan prior to beginning the third document scan, the white and 0.3 target areas are exposed in the inter document space. Shortly after the exposure of the white target 110, the electrometer 80 senses the voltage representative of the white target image area in the inter document space. Next, the carriage 114 scans the third document and toward the end of the third document scan, the 0.3 target 112 image area on the photoreceptor surface 12 has moved into position for sensing by the IRD sensor 92. If in the bias control mode, the sensed toner image for the 0.3 target is used to adjust the bias control voltage. After the third document scan, in the inter document space between the third and fourth copy scans, the iris aperture 91 is corrected in response to the white target image in the previous inter document space. The correction is shown by the arrow in FIG. 7 after the document three scan. The sequence is then generally repeated.

Specifically, with regard to the charge control loop, reference is made to FIGS. 1 and 2. The purpose of the charge control loop is to provide a uniform charge on the photoreceptor surface 12 by the charging electrode 16. For example, the standard operating condition can be assumed to be 900 volts sensed at the electrometer 80 to provide 850 volts at the first development roll 36. The control loop adjusts the high voltage power supply 86 for the charging corotron shield 17 to provide a 900 volt reading at the electrometer 80. The 50 volt differential allows for normal voltage discharge or photoreceptor decay between electrometer 80 and developer roll 36.

Generally, the solenoid 104 is activated once for every two copies made. Test target 100 is positioned in the optical path at the same location as target 102 to provide a composite image on the photoreceptor surface 12. At the predetermined inter document space, therefore, test target 100, specifically opaque target 106 is inserted into the optical path at the photoreceptor and the test target 102 specifically white target 110 is also in the optical path. The effect of the white target 110 is inconsequential, however since the white and opaque overlap.

There will be no light imaged upon the photoreceptor surface 12 in the area corresponding to opaque target 106 and therefore the photoreceptor potential should remain at or near 900 volts, the charging voltage. However, due to photoreceptor dark discharge variations due to light enhancement and photoreceptor aging the voltage sensed at the electrometer 80 may be less than 900 volts. In this case, the voltage at the shield 17 is adjusted.

Referring to FIG. 8, after the opaque target is imaged, there is a slight delay in time until the target images reaches electrometer 80. The voltage is sensed at the electrometer 80 after the predetermined time delay and conveyed to controller 82 through conversion circuitry 84. The controller 82 then calculates the expected voltage at the first development roll 36 based on the sensed voltage. This voltage is compared in the controller 82 with a reference or preferred potential, assume 850 volts, to provide a digital error signal DDP (dark development potential). This error signal is used to calculate or determine a new charging voltage Vs required to provide 850 volts at the development roll 36. If the system is not in a two second warmup, there is a time delay before changing the charging voltage through power supply 86. The change in power supply 86 causes the charge corotron to increase the charge voltage at the photoreceptor surface 12 to be able to maintain 850 volts at development roll 36.

This digital error signal is converted through a digital to analog converter to drive the conductive shield 17 voltage to provide the correct voltage on the photoreceptor at the charging corotron. The photoreceptor voltage at the first development roll 36 is therefore maintained at 850 volts by adjusting the voltage at the charging corotron shield 17 as required. In other words, electrometer 80 senses and transmits the photoreceptor surface voltage level to the controller 82 for comparing to the reference 850 volts and determines the adjustment needed in the corotron shield 17 voltage to provide 850 volts at developer roll 36.

With reference to FIG. 8*a*, there is illustrated for explanatory purposes, a plot of corotron shield voltage in the bottom graph and dark development potential (DDP) in the top graph as a function of the copy cycle in the reproduction machine. The top graph is a plot of the voltage sensed by the electrometer 80 corresponding to the imaging of the opaque target 106. The dotted line in the top graph illustrates the normal or desired dark development potential. The bottom graph is a plot of the voltage applied to the shield 17 of the charge corotron. In particular, there is shown the response or correction to the shield voltage corresponding to the voltage sensed by the electrometer 80. The abscissa of the plot represents copy cycles. It should be noted that these graphs are not to scale or an accurate representation of the actual machine operation but merely illustrate the principle of operation.

In the zero copy or precopy stage, in the top graph there is initially shown a relatively low dark development potential on the photoreceptor sensed by electrometer 80. In response, the shield voltage is stepped from an initial level to a first level to decrease the amount of shield voltage. This increases the dark development potential sensed by the electrometer 80 and raises the dark development potential to the normal potential. There is then illustrated a gradual decay of the dark development potential in the first and second copy cycles. At the end of the second copy cycle, the sensed dark development potential is low enough to require a correction. The response is that the shield voltage is raised from the first to the second level causing the dark development potential to rise to the normal potential or slightly above the normal potential. The sequence is repeated and the shield voltage is periodically increased to additional levels to compensate for the dark development potential decay.

With regard to the illumination control loop, as seen in FIGS. 2 and 9, the iris 31 located on the document side of the lens 30, opens and closes in discrete steps to eliminate variations in lamp irradiance and photoreceptor aging to maintain a constant background potential. That is, the background of a document image on photoreceptor surface 12 must be discharged below a predetermined level to insure a white background on the copy.

In particular, with reference to FIG. 9, upon completion of the charge control cycle, the white target 110 is imaged and the electrometer 80 senses the white target 110 image potential. It should be noted that the target 100 is not inserted into the optical path at this time to prevent the opaque target 106 from interfering with the white target 110 image. In order for the electrometer 80 to sense the white target image potential or any image potential, the controller 82 provides a signal to activate the electrometer 80 and the electrometer 80 transmits a signal back to the controller 82 through an analog to digital converter. Based upon the electrometer signal, the controller 82 determines the background potential that will be on the photoreceptor surface 12 at the first development roll 36. This potential is compared to a reference background voltage for example, 125 volts. An error signal is generated and in response to this error signal, the controller 82 determines the amount of change of exposure or illumination needed to provide the correct background potential at the first development roll 36.

After this determination, the determined change of exposure is compared to a 2.8 percent change of exposure. If it is not greater than 2.8 percent, no adjustment is made. However, if it is greater than 2.8 percent, a second comparison is made to determine if the required change of exposure is greater than 5.6 percent. If not greater than 5.6 percent, there will be a one step adjustment to close or open the iris depending upon the polarity of the determined change of exposure. If, however, the required change of exposure is greater or equal to 5.6 percent, there will be a two step change in the iris position, either to open or close in accordance with the polarity determination.

With reference to FIG. 9*a* there is illustrated a plot of background potential and iris position as a function of copy cycle. The top graph shows the normal or desired background potential as a dotted line and the solid line is the background potential as sensed by the electrometer 80. The bottom graph, illustrates the opening of the iris 31 in the vertical upward direction and the closing of the iris in the vertical downward direction. As shown in FIG. 6, the iris correction is made during the precopy scan cycle at the end of the third copy cycle, fifth copy cycle and on odd copy cycles thereafter, if required. In particular, during the precopy scan cycle, the iris is shown initially in position one. During the precopy cycle, the background potential is shown to be relatively high with reference to the normal potential. The high voltage sensed by the electrometer 80 indicates low light output as a result of the reflection from the white target 110. The relatively low light output and high voltage sense indicates the need to open the iris.

Assuming a greater than 5.6 percent change is needed, the iris is opened in two steps, moving from position 1 to position 2 on the bottom graph being the equivalent of two steps. The opening of the iris 31 permits the greater amount of light output reflected from the white target 110 onto the photoreceptor. The developed patch on the photoreceptor corresponding to the white target area will then be sensed as a much lower background potential voltage, at or near the normal desired potential voltage. This is illustrated in the top graph until the end of the third copy cycle. Then there is shown a sharp step decrease in the background potential. The relatively low voltage indicates that the light output is too high and that it is necessary to close the iris 31. At this point, the iris is closed one step to position three.

This will cause less light and therefore a higher voltage to be measured by the electrometer 80 at or near the normal potential. This condition is illustrated as existing until after the seventh copy cycle. At this point, the sensed electrometer voltage is relatively high with respect to the normal voltage. This indicates light output too low and it is therefore necessary to open the iris 31 for the greater light reflection. Thus, it is shown in the lower graph that the iris is opened one step, shown as position 4. This general sequence continues to continually open and close the iris to adjust the background potential to follow the normal potential level.

The bias control and automatic development control (ADC) loops are responsive to signals generated by the infrared densitometer (IRD) sensor 92. The infrared densitometer 92 transmits light to the developed test target image. The densitometer 92 then senses the light reflected from the target image and the sensed light is converted to an electrical signal.

For bias control with test target 100 retracted from the optical path, light will be projected from white target 110 and 0.3 density target 112 of test target 102. The image on the photoreceptor surface 12 corresponding to the 0.3 solid area target 112 will be developed with toner at the developer station and then sensed by IRD sensor 92. The signal produced by IRD sensor 92 is proportional to toner mass development on the portion of the photoreceptor surface 12 corresponding to the 0.3 solid area target image. This signal will be conveyed to controller 82. In response to this signal, controller 82 controls the bias on developer rolls 36 and 38 through bias control 96.

During the precopy scan cycle, controller 82 determines whether to initiate the bias control loop operation after the illumination and charge corotron adjustments have been made. Generally in conditions of high humidity and before machine warm up, an excessive amount of toner will be deposited on the photoreceptor during the development cycle. Developer material in electrographic machines commonly comprise a mixture of suitably pigmented particles known as toner and a granular carrier material carrying the toner by means of an electrostatic attraction. To dislodge the toner particles from the carrier, a suitable electrostatic field is provided between the photoreceptor surface and the toner. Preferably, this electrostatic field is provided by a suitable voltage or bias on the rotatably tubular members of the developer rollers at the development station. Generally, the higher or greater the developer roll bias, the greater the resistance to the attraction of toner to the photoreceptor surface.

The amount of toner deposited on the photoreceptor depends upon factors such as the electrostatic attraction between the toner and the carrier, the electrostatic field between the photoreceptor and the developer rollers and also the amount of toner contained within the developer housing. In high humidity conditions, the electrostatic attraction between the carrier and toner particles is reduced, resulting in an excessive deposit of toner on the photoreceptor.

An excessive amount of toner on the developed section, sensed by infrared densitometer 92, will result in an error signal. This error signal initiates an initial increase in the bias voltage to developer rolls 36 and 38. After this initial increase in bias, the bias control operation consists of lowering the bias voltage, when required, in step fashion down to the normal bias level while maintaining the desired output toner density. The bias level is lowered as the humidity in the developer sump decreases due to a general decrease in humidity outside the machine and due to internal machine warm up. Initially, raising the bias voltage increases the electric field between the developer and the photoreceptor surface and lowers the developed density to the desired level. As the humidity decreases, the electrostatic charge between the toner and carrier increases requiring that the bias level be reduced.

The sensing of the developed toner mass by infrared densitometer 92 is repeated during the copy cycle and the bias voltage is decreased, if required, in small step increments during the copy cycle to maintain the signal generated by the densitometer 92 within the desired limits. This indicates that the developed image solid area density is within acceptable limits. The lowering of the bias level ultimately to the normal bias level, as sensed by analog to digital circuitry, results in deactivation of the bias control.

In particular, with reference to FIG. 10, after the charge and illumination corrections have been made, the 0.3 density target is imaged and after a suitable delay, the developed image is sensed by the infrared densitometer 92. Initially, if a high humidity condition exists, there will be excessive toner on the photoreceptor surface and a signal exceeding an "overtoned" reference signal will be generated. This signal will cause the bias level to be initially raised to a voltage level above the nominal or normal bias voltage level, bringing the solid area density within the acceptable limits. The toner dispense control loop is deactivated during bias control operation to prevent addition of toner.

Thereafter, the infrared densitometer signal is compared to a normal reference signal or voltage. If the sensed voltge is not greater than the reference voltage, the developed image is at the proper solid area density and no change in bias control is initiated. If the sensed voltage, however, is greater than the reference voltage indicating an unacceptably high image density, a decrease in bias voltage is performed. The new bias is determined and stored. The adjusted bias voltage is at a level which provides the proper developed image density. In other words, during the copy cycles, a sensed voltage from the 0.3 density target is compared to a normal density reference and if the density is low, the bias level is decreased by a small increment. The lower developed image density is due to greater electrostatic charge attraction between the toner and carrier during machine warm up and due to toner depletion since the toner dispense control is disabled. The comparison of the densitometer 92 signal with the reference, the removal of the low charged toner to the copy paper and the stepping down of developer bias is repeated during the copy cycle until the bias is decremented to the normal setting. At this point, the toner dispense system is enabled and bias control disabled.

The 0.3 solid area density target is sensed once every photoreceptor cycle or two copy cycles. Initially, with reference to FIG. 10*a* during the precopy scan, because of the high humidity condition, there will be an excessive amount of toner deposited on the photoreceptor. This will produce a relatively high sensor signal by IRD sensor 92 shown in a solid line in the bottom graph. The dotted line represents normal bias level voltages. This signal will be monitored and result in the generation of a very high developer roll bias level 1 on the top graph showing bias voltage to inhibit the attraction of toner particles to the photoreceptor. For the next 0.3 solid area density test reading, much less toner will be attracted to the test patch and a normal or near normal test signal will be generated by the IRD sensor 92. For a period of time as shown by four copy cycles in the graph, the normal amount of toner will be deposited on the test patch to maintain a 0.3 solid area development. However, as the machine warms up, moisture is driven from the developer sump and there is a greater attraction between the toner and carrier.

Thus, it will be more difficult to attract the desired amount of toner onto the photoreceptor and eventually as shown in the graph, there will be a reading from the IRD sensor 92 indicating less than desired amount of toner deposited on the photoreceptor. Also contributing to the lesser amount of toner on the photoreceptor is the fact that toner is being depleted from the developer housing while the toner dispense control is disabled. At this point, as shown at the end of the copy 4 cycleon the graph, the response is to lower the bias to level 2 on the developer rollers. The lower the bias, the greater the attraction or field between the photoreceptor and the developer rolls to attract the toner particles onto the photoreceptor. This will increase the amount of toner on the photoreceptor to within the desired 0.3 solid area development level.

This sequence will continue with the developer bias being decreased in step increments as the moisture is driven from the developer sump and the toner in the housing is depleted until the bias level has been reduced to the normal bias level. The step decrements are necessarily small to prevent unacceptable density variations within the copy. When the developer bias has been reduced to the normal level, the bias control is disabled and the toner dispense control is enabled.

The ADC or toner dispense control is responsive to signals generated by the IRD sensor 92 in response to a 0.7 solid area density target being developed on the photoreceptor surface 12. The IRD sensor signal is generated as a result of test target 100 being inserted into the optical path resulting in the overlapping of the 0.4 solid area density target 108 and the 0.3 solid area density target 112 and the subsequent development of the composite image on the photoreceptor surface 12 at the developer station. The signal generated by the IRD sensor 92 is representative of the amount of toner mass on the surface 12 corresponding to the 0.7 solid area image. The signal is conveyed to controller 82 and in response, the controller 82 controls a motor or dispenser roll control 98. The dispenser control motor 98 activates a dispenser roll 99 to supply additional toner particles from the cartridge 41 to the developer housing 34 on a controlled duty cycle basis.

In operation, with reference to FIG. 11, a toner free photoreceptor surface measurement is made one photoreceptor cycle in advance of the first IRD sensor 92 density measurement in the same position that the 0.7 test patch will be developed. This signal is stored and utilized to compensate for photoreceptor substrate reflectivity differences that would contribute an error in the IRD sensor 92 signal generated. The IRD sensor 92 senses the photoreceptor area without toner, at a position where the test target will be developed one photoreceptor revolution later, to normalize out circumferential photoreceptor substrate reflectivity variations and the resultant IRD sensor 82 signal errors. Normalization is periodically performed during the copy run at twelve copy or three photoreceptor revolution intervals when the "clean drum" area coincides with 0.7 test target development area. This signal is stored in memory as a clean drum signal and is updated preferably every twelve copies and at the start of a new copy run.

A signal from the controller 82 activates the solenoid for inserting the 0.4 test target into the optical path at the photoreceptor surface 12 when the lamp 24 reaches the target scan position. A 0.7 density area target is imaged and the image then travels to the sensor 82 and the sensor interrogates the 0.7 density developed sample and transmits the analog signal through a suitable amplifier and buffer stage and A/D converter to the controller 82. The signal is then compared with the 0.7 density normal reference voltage stored in the suitable controller memory. If the sensed voltage is greater than the normal reference voltage, the toner dispense motor 98 is shut off. On the other hand, if the voltage is less, the toner dispense motor 98 is then driven to dispense toner at either a normal or high rate in response dependent on the degree to which the signal is less than the threshold signal which is also stored in non volatile memory.

With reference to FIG. 11*a*, there is illustrated a plot in the top graph of the 0.7 area density signal generated by the IRD sensor. The dotted line represents the desired 0.7 density signal. The bottom graph illustrates two speeds of a toner dispense motor. As shown in FIG. 6, the corrections for the toner dispenser are made preferably at the end of copy cycle 2, copy cycle 4 and every even copy cycle if required. For example, as shown in the top graph, at the end of the second copy cycle, there is shown a step decrease below the normal 0.7 density signal. The toner dispenser motor is normally off. If the signal generated by the IRD sensor indicates low toner density below the normal 0.7 density, it is necessary to activate the toner dispenser motor.

In this case, the lower graph at the end of copy cycle 2 shows the activation of the dispense motor at the low speed. The motor remains on delivering toner to the developer housing until the IRD sensor 92 indicates an amount of toner density sufficiently greater than the normal 0.7 toner density. At this point the dispense motor is shut off and as the machine continues to make copies and use up toner, the toner density may decrease until a point as shown in the lower graph, that is, after the copy cycle 6, the 0.7 density has fallen to a point below the normal 0.7 density requiring activation of the dispense motor. The lower graph shows that during copy cycle 7, the dispense motor is activated at the high speed again adding toner to the developer housing until the point where the signal generated by the IRD sensor indicates a toner density well above the normal 0.7 density. This process continues with the dispense motor being activated as required and the adjustment or activation of the toner dispenser being made if required preferably after each even copy cycle.

The dispensing of toner from the hopper is accomplished by movement of dispenser roll 99 which rolls toner from the cartridge to the sump. By activating the motor 98 a given amount of time the dispenser roll 99 will deliver a given amount of toner.

While there has been illustrated and described what is at present considered to be a preferred embodiment of the present invention, it will be appreciated that numerous changes and modifications are likely to occur to those skilled in the art for example, the invention can be incorporated into laser scanning systems driven by electronically represented images, and it is intended in the appended claims to cover all those changes and modifications which fall within the true spirit and scope of the present invention.

I claim:

1. In a reproduction machine having a corona device for charging a photoreceptor, an illuminator for projecting an image of an object on a platen along an optical path onto the photoreceptor, a developer for applying toner to the photoreceptor, and a toner dispenser to provide toner to the developer, the method of optimizing machine operation using a sample data control system comprising the steps of:

disposing test targets into the optical path causing characteristics on the photoreceptor surface, sensing the characteristics on the photoreceptor surface by the test targets, analyzing the sensed signals to determine optimum processing conditions, selectively regulating the corona device, the illuminator, the developer and the toner dispenser and repeating the sequence at predetermined intervals.

2. The method of claim 1 wherein the step of disposing the test targets into the optical path includes the step of moving one of the test targets, disposed near the photoreceptor, into the optical path at the photoreceptor.

3. The method of claim 1 wherein the step of disposing the test targets into the optical path includes the step of scanning one of the test targets secured near the platen.

4. The method of claim 1 wherein one of the test targets is opaque and the reproduction machine includes an electrometer, the step of sensing by the electrometer of a portion of the photoreceptor responsive to an image of the opaque target in order to control the corona device.

5. The method of claim 4 wherein one of the test targets is white and the electrometer senses a portion of the photoreceptor responsive to the white target to control the illuminator.

6. The method of claim 1 including an infrared densitometer wherein a portion of one of the test targets provides a first predetermined developed patch on the photoreceptor and a portion of another if test targets provide a second predetermined developed patch on the photoreceptor, and the infrared densitometer is responsive to the first developed patch to control the developer bias and is responsive to the second developed patch to control the toner supply dispenser.

7. In a reproduction machine having a photosensitive member, a corotron device for charging the photosensitive member, an illumination and projection system for projecting images disposed on a platen along an optical path onto the photosensitive member, a developer for applying toner particles to the photosensitive member, and a toner dispenser for supplying toner to the developer, the combination of a first test target disposed near the photosensitive member, the test target movable into and out of the optical projection path, the first test target having an opaque target portion and a 0.4 solid area density portion, a second test target fixedly located at the edge of the platen, the second test target having a white target portion and a 0.3 solid area density portion, the first test target overlapping along the optical path the second test target upon movement of the first test target into the optical path, an electrometer disposed near the photosensitive member, the electrometer generating signals in response to imaging of the opaque portion of the first test target to control the corotron device, the electrometer producing signals in response to the imaging of the white portion of the second test target to initiate control of the illumination system, an infrared densitometer located near the photosensitive member, the infrared densitometer being responsive to the 0.3 solid area density target of the second test target to initiate control of the developer bias, and the densitometer being responsive to the overlapping 0.4 and 0.3 solid area density portions to initiate control of a toner dispenser.

8. Apparatus for controlling the operation of a reproduction machine having an optical path comprising:

a controller, a first test medium, a driver, the driver moving the first test medium into and out of the optical path, the photosensitive surface manifesting the presence of the first test medium in the optical path and a sensor responsive to the characteristics of the photosensitive surface for producing signals, the controller responsive to the signals for controlling machine operation.

9. The apparatus of claim 8 wherein the first test medium is disposed near the photosensitive surface.

10. The apparatus of claim 9 including a platen and a second test medium secured near the platen, the characteristics of the photosensitive surface manifesting the presence of the second test medium in the optical path.

11. The apparatus of claim 10 including an optical scanner for scanning objects on the platen and for scanning the second test medium, the scanning of the second test medium coinciding with the presence of the first test medium in the optical path.

12. The apparatus of claim 11 wherein the presence of the test mediums together in the optical path provides a cumulative effect on the photosensitive surface.

13. The apparatus of claim 12 wherein the first test medium has a 0.4 density portion and the second test medium has a 0.3 density portion, together providing a 0.7 density effect on the photosensitive surface.

14. The apparatus of claim 8 wherein the first test medium is a test target having an opaque portion and a first density portion.

15. The apparatus of claim 10 wherein the second test medium is a test target having a white portion and a second density portion.

16. Apparatus for controlling the operation of a reproduction machine having an optical path for projecting an image of an object on a platen onto a photosensitive surface, comprising:

a controller, a plurality of test mediums, means to dispose the test mediums in overlapping relationship in the optical path, the characteristics on a portion of the photosensitive surface manifesting the presence of the overlapping test mediums in the optical path, and a sensor responsive to the portion of the photosensitive surface manifesting the overlapping test mediums for producing signals, the controller responsive to the signals for changing the operation of the machine.

17. The apparatus of claim 16 wherein one of the test mediums is disposed near the platen.

18. The apparatus of claim 16 wherein one of the test mediums is stationary and another is movable into and out of the optical path.

19. The apparatus of claim 18 wherein the stationary test medium is optically scanned.

20. The apparatus of claim 19 wherein the movable test medium is disposed near the photosensitive surface.

* * * * *